US005993277A

United States Patent [19]

Hattori

[11] Patent Number: 5,993,277

[45] Date of Patent: Nov. 30, 1999

[54] METHOD FOR MANUFACTURING FIELD EMISSION DEVICE

[75] Inventor: Atsuo Hattori, Hamamatsu, Japan

[73] Assignee: Yamaha Corporation, Japan

[21] Appl. No.: 09/123,838

[22] Filed: Jul. 28, 1998

[30] Foreign Application Priority Data

Jul. 31, 1997 [JP] Japan ..... 9-206836

[51] Int. Cl.[6] ..... H01J 9/02

[52] U.S. Cl. ..... 445/24; 445/50

[58] Field of Search ..... 445/24, 50

[56] References Cited

U.S. PATENT DOCUMENTS

| | | | |
|---|---|---|---|
| 5,720,642 | 2/1998 | Hattori | 445/24 |
| 5,795,208 | 8/1998 | Hattori | 445/24 |
| 5,839,934 | 11/1998 | Hattori | 445/24 |

OTHER PUBLICATIONS

M. Urayama et al., "Silicon Field Emitter Capable of Low Voltage Emisson", Technical Report of IEICE, ED93–147 (1993–12), pp. 89–93.

*Primary Examiner*—Kenneth J. Ramsey

*Attorney, Agent, or Firm*—Ostrolenk, Faber, Gerb & Soffen, LLP

[57] ABSTRACT

A method for manufacturing a field emission device includes the steps of: forming a first sacrificial film on a substrate; forming a recess which has side walls almost perpendicular to the first sacrificial film and which extends up to the substrate; forming a second sacrificial film on the first sacrificial film and in the recess; etching back the second sacrificial film so as to leave side spacers on the side walls of the recess; forming a first conductive film as a gate electrode on the first sacrificial film, the side spacers and an exposed part of the substrate; etching back the first conductive film so as to expose the substrate at the bottom of the recess; forming a first insulation film on the first conductive film; forming a second conductive film as an emitter electrode on the first insulation film; and exposing an end portion of the second conductive film.

11 Claims, 14 Drawing Sheets

METHOD FOR MANUFACTURING FIELD EMISSION DEVICE

This application is based on Japanese Patent Application No. 9-206836 filed on Jul. 31, 1997, the entire contents of which are incorporated herein by reference.

BACKGROUND OF THE INVENTION a) Field of the Invention

The present invention relates to a method for manufacturing a field emission device, and more particularly to a method for manufacturing a field emission device which emits electrons by controlling a gate potential.

b) Description of the Related Art

A field emission device includes an emitter (field emission cathode) which emits electrons from its pointed end or tip by focused electric field. For example, a flat panel display includes a field emitter array (FEA) comprising an arrangement of a large number of emitters. Each emitter controls the brightness, etc. of a corresponding pixel of the display.

FIGS. 7A to 7E illustrate a method for manufacturing a conventional field emission device. Firstly, an $SiO_2$ layer is formed on a silicon substrate by thermal oxidation, after which an $SiO_2$ layer 52 is formed by a predetermined pattern on the silicon substrate 51 by photolithography, as illustrated in FIG. 7A.

Next, using the $SiO_2$ layer 52 as a mask, the isotropic etching of the silicon substrate 51 is conducted to form a silicon substrate 51*a* having a projecting part located under the $SiO_2$ layer 52, as illustrated in FIG. 7B. In this case, the etching is finished before the removal of the $SiO_2$ layer 52.

Following the above, a surface of the silicon substrate 51*a* is oxidized by thermal oxidation so that an SiO2 layer 54 is formed on a surface of a silicon substrate 51*c* as illustrated in FIG. 7C. The silicon substrate 51*c* is used as an emitter. The emitter 51*c* has a pointed end or a tip.

Next, as illustrated in FIG. 7D, niobium (Nb) is obliquely deposited to form gate electrode layers 53*b* and 53*a* on the SiO2 layers 54 and 52, respectively.

Subsequently to the above, that part of the $SiO_2$ layer 54 which covers the tip of the silicon substrate 51*c* is removed by etching. As a result, the tip of the silicon substrate (emitter) 51*c*, whose bottom part is covered by an $SiO_2$ layer 54*a*, reveals as illustrated in FIG. 7E.

In the field emission device manufactured in the above-described manner, a leak current and a short circuit can easily occur for the following three reasons:

The first reason is that when the gate electrode layers 53*a* and 53*b* are deposited obliquely as illustrated in FIG. 7D, the gate electrode layer 53*a* tends to be deposited also on the sides and lower surface of the $SiO_2$ layer 52.

When Nb 50 is impinged vertically on the substrate as illustrated in FIG. 8A, the Nb layer 53*a* is hardly deposited on the lower surface (back surface) of the $SiO_2$ layer 52. In this case, however, a gate diameter R1 is undesirably large. The gate diameter R1 is the diameter of a circular hole (gate hole) in the Nb layer (gate electrode layer) 53*b* deposited on the $SiO_2$ layer 54. If the gate diameter R1 is large, a high voltage has to be applied to the gate 53*b* so that the emitter 51*c* can emit electrons. In order to lower the voltage, Nb 50 is impinged at an angle θ with respect to a direction (normal line) perpendicular to the substrate, as illustrated in FIG. 8B. Under this condition, the gate diameter RI is small. However, not only the Nb layer (gate electrode layer) 53*b* is deposited on the $SiO_2$ layer 54, but also the Nb layer 53*a* is deposited thick on the sides and lower surface (back surface) of the $SiO_2$ layer 52. Furthermore, a thin Nb layer 53*c* is deposited near the border of the $SiO_2$ layers 52 and 54, and the Nb layers 53*a* and 53*b* are mutually connected.

When the top part of the $SiO_2$ layer 54 is removed by etching afterwards, the thick Nb layer 53*a* may adhere to the top parts of the gate 53*b* and emitter 51*c*, as illustrated in FIG. 9A. The Nb layer 53*a*, which is in contact with the gate 53*b* and the emitter 51*c* in areas 62, causes a short circuit. Moreover, the above-mentioned etching may result in the thin Nb layer 53*c* adhering to the top part or vicinity of the emitter 51*c* or gate 53*b*, as illustrated in FIG. 9B. Though the Nb layer 53*c* does not cause a short circuit between the emitter 51*c* and the gate 53*b*, it causes the flow of a leak current.

The second reason is that the thickness of the $SiO_2$ layer 54*a* is uniform as seen from FIG. 7E. In other words, the interval between the tip of the emitter 51*c* and the gate 53*b* is equal to that between the bottom part of the emitter 51*c* and the gate 53*b*. When the interval between the emitter and the gate is short, an intense electric field is applied not only to the tip of the emitter but also to the bottom part of the emitter, under which condition the electric breakdown can easily occur.

The third reason is that the $SiO_2$ layer 54*a* is a thin layer having a uniform thickness, and a capacitance between the emitter 51*c* and the gate 53*b* is large.

SUMMARY OF THE INVENTION

It is accordingly an object of the present invention to provide a method for manufacturing a field emission device whose gate diameter is small.

It is another object of the present invention to provide a method for manufacturing a field emission device in which the electric breakdown does not easily occur.

According to the first aspect of the present invention, there is provided a method for manufacturing a field emission device, the method comprising the steps of: (a) forming a first sacrificial film on an upper surface of a substrate; (b) forming a recess in the first sacrificial film; (c) forming a second sacrificial film on the first sacrificial film and in the recess; (d) anisotropically etching back the second sacrificial film, thereby to leave, as side spacers, parts of the second sacrificial film which are located on side walls of the recess and to expose the first sacrificial film and a part of the substrate; (e) forming a first conductive film as a gate electrode on the first sacrificial film, the side spacers and the exposed part of the substrate, the first conductive film as formed having a thick part located on the first sacrificial film and a thin part located on the substrate; (f) etching back the first conductive film, thereby to expose the substrate at a bottom of the recess and to leave the first conductive film on the first sacrificial film; (g) forming a first insulation film with a cusp on the first conductive film; (h) forming a second conductive film as an emitter electrode on the first insulation film; and (i) exposing an end portion of the first conductive film and an end portion of the second conductive film.

A field emission device having a small gate diameter can be attained by forming the first sacrificial film with a recess, and thereafter forming the side spacers on the side walls of the recess, and thereafter forming the first conductive film serving as a gate electrode. The small gate diameter permits the emitter electrode to emit electrons even when a potential applied to the gate electrode is low.

BRIEF DESCRIPTION OF THE DRAWINGS

FIG. 8A is a cross section showing the step of forming a gate electrode layer by vertically impinging Nb, while FIG. 9A is a cross section of a field emission device in which a short circuit has occurred, while

DETAILED DESCRIPTION OF THE PREFERRED EMBODIMENTS

FIGS. 1A to 1J illustrate the steps of manufacturing a field emission device according to the first embodiment of the present invention. Explanations will now be made to the steps of manufacturing a two-electrode field emission device including an emitter (field emission cathode) and a gate.

Figure 1A:
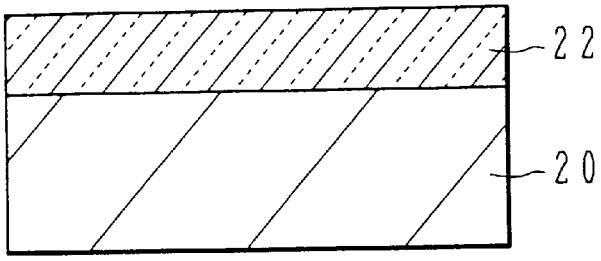
FIGS. 1A to 1K are cross sections showing the steps of manufacturing a field emission device (two-electrode device) according to the first embodiment of the present invention.

In FIG. 1A, a substrate 20 is made of Si, for example. A first sacrificial film 22, which is made of $SiN_x$, for example, is formed on the substrate 20 by reduced pressure chemical vapor deposition (CVD). The thickness of the first sacrificial film 22 is approximately 0.2 $\mu$m. The first sacrificial film 22 is formed under the conditions wherein $NH_3$ and $SiH_2Cl_2$ are used as material gasses and wherein the temperature of the substrate is set at 760° C. In place of Si, Al can be used to form the substrate 20. When the substrate 20 is formed using Al, the first sacrificial film 22 can be formed using $Al_2O_3$. The first sacrificial film 22 is not limited to an insulation film, and may be a conductive film. The sacrificial film 22 may be made of $SiO_xN_y$, poly-Si, $WSi_x$ or $TiN_x$.

Figure 1B:
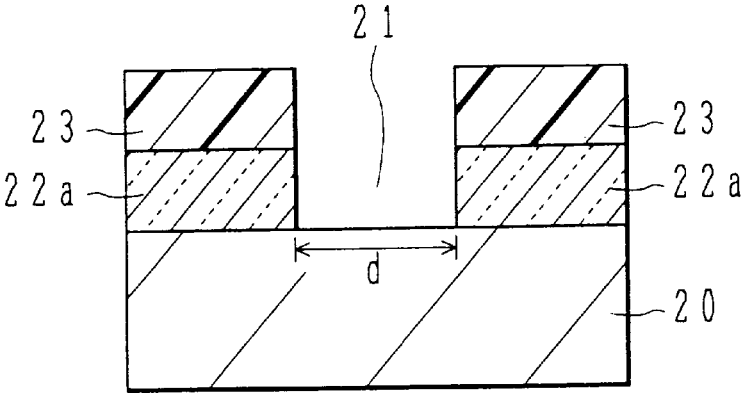

Next, a resist film 23 (FIG. 1B) is formed by a predetermined pattern on the first sacrificial film 22 by photolithography, and the first sacrificial film 22 is selectively and anisotropically etched using the resist film 23 as a mask so that a first sacrificial film 22*a* with a recess 21 having almost vertical side walls is formed as illustrated in FIG. 1B. The recess is circular when seen in plan view, and has a diameter d of approximately 0.5 $\mu$m and a depth of approximately 0.2 $\mu$m. The residual first sacrificial film 22*a*, when seen in cross section, has a right part and a left part.

Figure 1C:
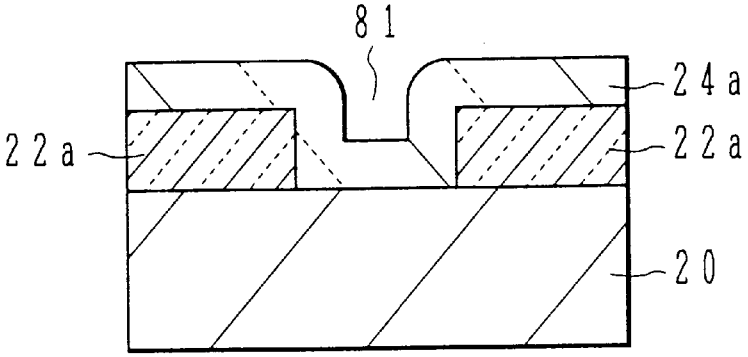

Following the above, a second sacrificial film 24*a* of $SiO_2$, for example, is formed on the first sacrificial film 22*a* and an exposed surface of the substrate 20, as illustrated in FIG. 1C. The second sacrificial film 20*a* is deposited by a deposition method whose step coverage is excellent. For example, using $O_3$ and TEOS as materials and setting the temperature of the substrate at 400° C., the atmospheric pressure chemical vapor deposition (CVD) is conducted. The thickness of the second sacrificial film 24*a* is approximately 0.15 $\mu$m. Due to the recess 21 formed in the underlying surface, the second sacrificial film 24*a* has thereon a recess 81 smaller than the recess 21. The second sacrificial film 24*a* needs only be made of a material having an etching selectivity with respect to a gate electrode which will be discussed later, and can also be formed using a semiconductor or a conductor instead of $SiO_2$.

Figure 1D:
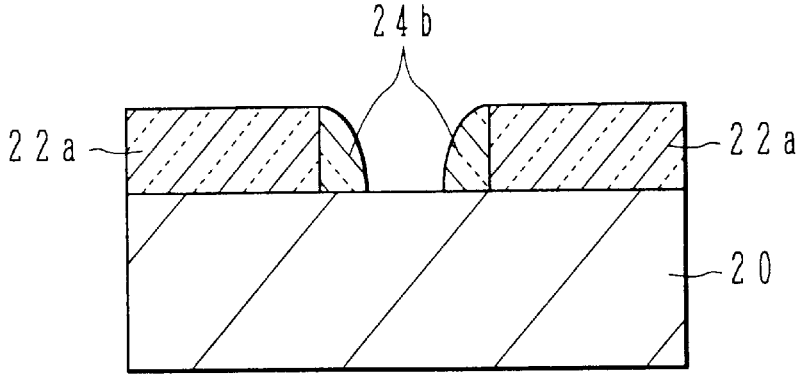

After the above, the second sacrificial film 24*a*, which is made of $SiO_2$, is anisotropically etched back so that the second sacrificial film 24*a* is left as side spacers on the side walls of the first sacrificial film 22*a*, as illustrated in FIG. 1D. The aforementioned etching back is achieved by anisotropic dry etching. For example, using a mixed gas of $CHF_3$+$CO_2$+Ar as an etching gas and setting the internal pressure of the reaction chamber at 50 mTorr, the etching is conducted through utilization of a magnetron reactive ion etching (RIE) apparatus. It is preferred that the lower surface of the substrate be cooled by an inactive gas such as He, in order to prevent the resist from softening.

Figure 1E:
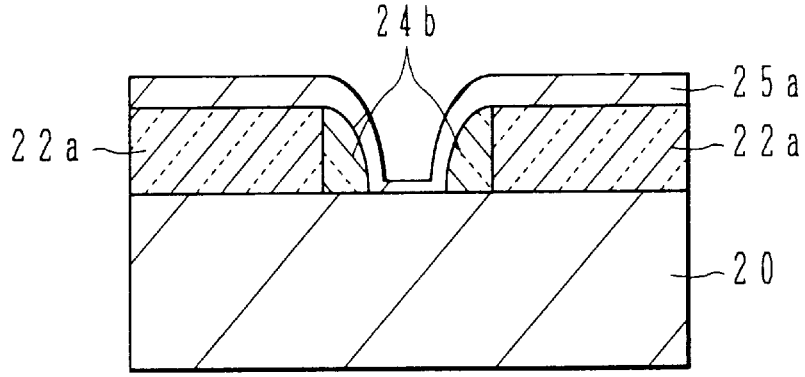

Next, as illustrated in FIG. 1E, a gate electrode 25*a* which is made of TiN, for example, is deposited over the entire substrate surface by a reactive sputtering method so that the gate electrode 25*a* has a thickness of 0.1 $\mu$m (this is the thickness of a portion on a large flat surface area). Using a Ti target and introducing an $N_2$+Ar gas as a work gas, the sputtering is conducted with a DC sputtering apparatus. The gate electrode 25*a* is deposited thick over the upper flat surface area, and is deposited thin over the lower flat surface area. Since the diameter of the recess is less than the depth thereof, the gate electrode 25*a* is not easily deposited in the recess. The thickness of those parts of the gate electrode 25*a* which are located on the side walls of the recess varies gradually. An ordinary sputtering method and/or vapor deposition method, conducted employing a TiN target and introducing Ar as a work gas, can also be adopted to deposit the gate electrode 25*a* which is made of TiN.

Figure 1F:
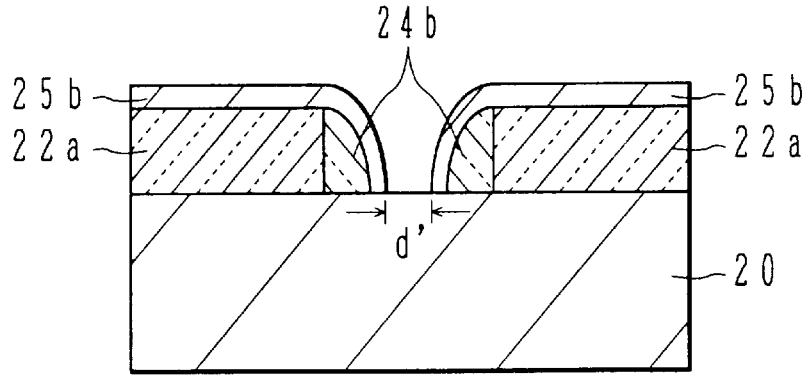

Subsequently to the above, the entire surface of the gate electrode 25*a* is anisotropically etched back by a thickness of approximately 0.05 $\mu$m so that the substrate 20 is exposed at the bottom of the recess (gate hole), as illustrated in FIG. 1F. A gate electrode 25*b* is left on the side surfaces of the side spacers 24*b* and the upper surface of the first sacrificial film 22*a*. This etching back is achieved by anisotropic dry etching. For example, using $Cl_2$ as an etching gas and setting the internal pressure of the reaction chamber at 125 mTorr, the etching is conducted through utilization of the magnetron reactive ion etching (RIE) apparatus.

In the actual steps, the diameter d' of the bottom of the recess (gate hole) could be reduced to 0.06 $\mu$m. In FIG. 1B, the diameter d' of the gate hole can be considerably reduced beyond a resolution limit by reducing the diameter d of the recess 21 up to the resolution limit and by forming the gate electrode 25*b* after the formation of the side spacers 24*b* (FIG. 1D).

Figure 1G:
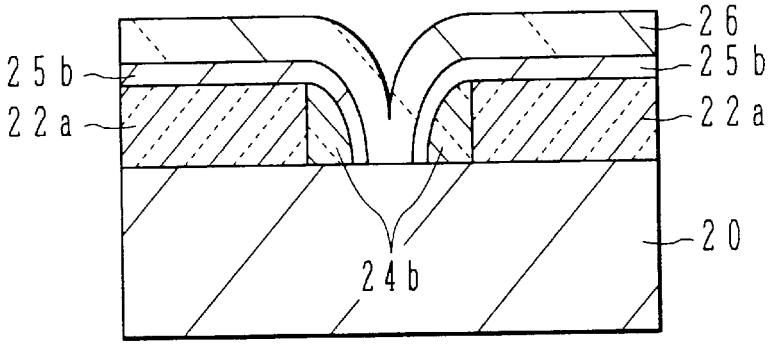

Next, as illustrated in FIG. 1G, a third sacrificial film 26, which is made of $SiO_2$, for example, is formed over the entire substrate surface by the atmospheric pressure CVD so that the third sacrificial film 26 has a thickness of 0.15 $\mu$m. The third sacrificial film 26 thus formed has a cusp, in other words, a recess with a pointed end. The third sacrificial film 26 is used as a mold for an emitter. The third sacrificial film 26 is formed under the conditions wherein $O_3$ and TEOS are used as material gasses and the temperature of the substrate is set at 400° C.

Figure 1H:
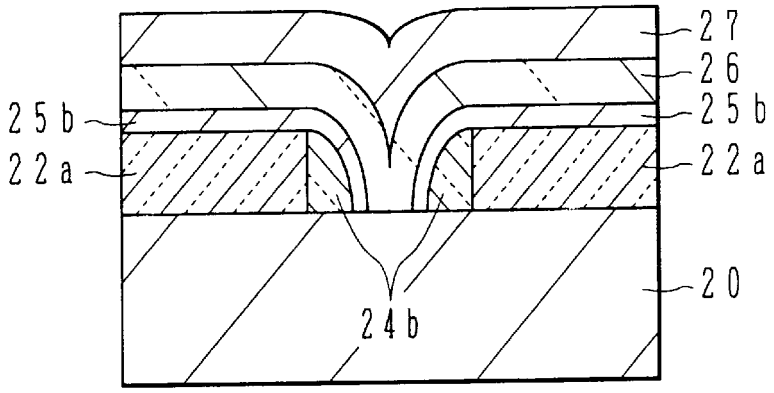

Thereafter, as illustrated in FIG. 1H, an emitter electrode 27, which is made of TiN, for example, is deposited over the entire substrate surface by the reactive sputtering method so that the emitter electrode 27 has a thickness of approximately 0.2 $\mu$m. Using a Ti target and introducing an $N_2$+Ar gas as a work gas, the sputtering is conducted through utilization of the DC sputtering apparatus. The emitter electrode 27 which corresponds to the cusp in the third sacrificial film 26, will be called a tip.

Figure 1I:
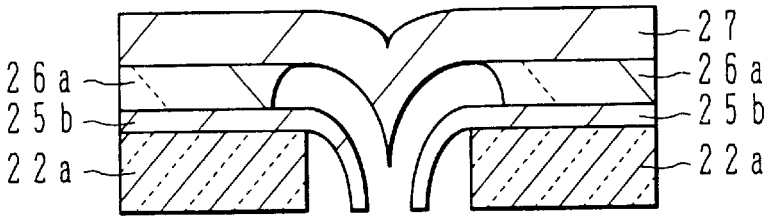

Then, the entire substrate 20, the entire side spacers 24*b* and a part of the third sacrificial film 26 are removed by etching, so as to leave a peripheral third sacrificial film 26*a* as illustrated in FIG. 1I. The etching of the substrate 20, which is made of Si, is performed using HF+$HNO_3$+$CH_3COOH$, while the etching of the side spacers 24*b*, which is made of $SiO_2$, and the etching of the third sacrificial film 26 are effected using HF+$NH_4F$.

Figure 1J:
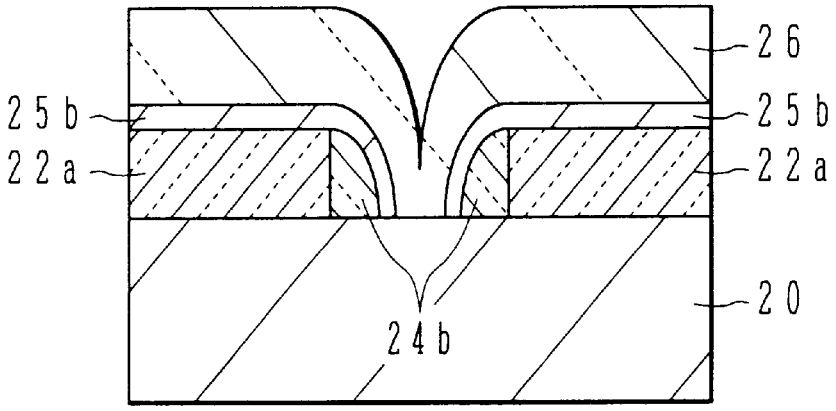
Figure 1K:
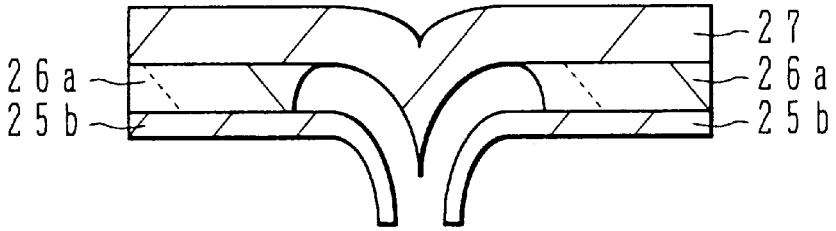

The first sacrificial film 22*a* may be made of $SiO_2$. In this case, the first sacrificial film 22*a* and the side spacers 24*b* are removed by the etching as illustrated in FIG. 1K.

The field emission device is finished in the above-describe manner. This field emission device includes the emitter electrode 27 and the gate electrode 25*b*. A negative potential is applied to the emitter electrode 27, and a positive potential is applied to a non-illustrated anode electrode. Applying the positive potential to the gate electrode 25*b* enables the emitter electrode 27 to emit electrons toward the anode electrode.

According to this embodiment, the diameter d' of the gate hole (FIG. 1F) can be reduced. A reduction in the diameter d' of the gate hole enables an intense electric field to be generated around the emitter electrode 27 so that the emitter electrode 27 can easily emit electrons, even in the case where a potential applied to the gate electrode 25*b* is low.

A method for manufacturing a field emission device, which prevents the occurrences of a leak current and a short circuit, will now be described.

In FIG. 1G, the third sacrificial film 26 is deposited so as to have a substantially uniform thickness by the deposition method whose step coverage is excellent. Instead of this, the step coverage during the film deposition according to a CVD method is controlled to partially change thickness of the third sacrificial film 26, as illustrated in FIG. 1J. More specifically, the third sacrificial film 26 is anisotropically deposited by a deposition method whose step coverage is not excellent. The third sacrificial film 26 is deposited thick over a flat surface area, and is deposited thin in the recess. The film depositing conditions are those wherein $SiH_4$ and $O_2$ are used as material gasses and wherein the temperature of the substrate is set at 500° C. An atmospheric pressure CVD furnace or a reduced pressure CVD furnace can be adopted. The atmospheric CVD furnace is inferior, in terms of step coverage, to the reduced pressure CVD furnace.

After the above, the same steps as those shown in FIGS. 1H and 1I are executed. By the step shown in FIG. 1I, the interval between the emitter electrode 27 and the gate electrode 25*b* can be set at the desired value. That is, the interval between the tip of the emitter electrode 27 and the gate electrode 25*b* can be set at a small value, while the interval between the bottom of the emitter electrode 27 and the gate electrode 25*b* can be set at a large value.

In applying a positive potential to the gate electrode 25*b*, an electric field applied to the tip of the emitter electrode 27 can be intensified, and an electric field applied to the bottom part of the emitter electrode 27 can be lowered. By so doing, the electric breakdown can be prevented from occurring between the emitter electrode 27 and the gate electrode 25*b*.

By reducing the interval between the tip of the emitter electrode 27 and the gate electrode 25*b*, the capacitance between the emitter electrode 27 and the gate electrode 25*b* can be reduced.

Figure 2A:
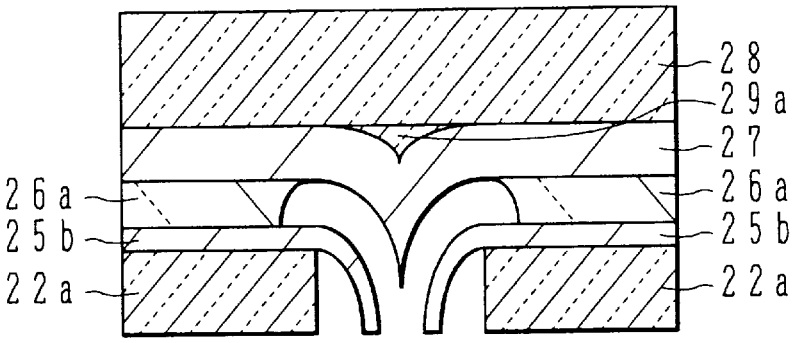
FIGS. 2A and 2B are cross sections showing two methods for reinforcing the field emission device with a supporting substrate.
Figure 2B:
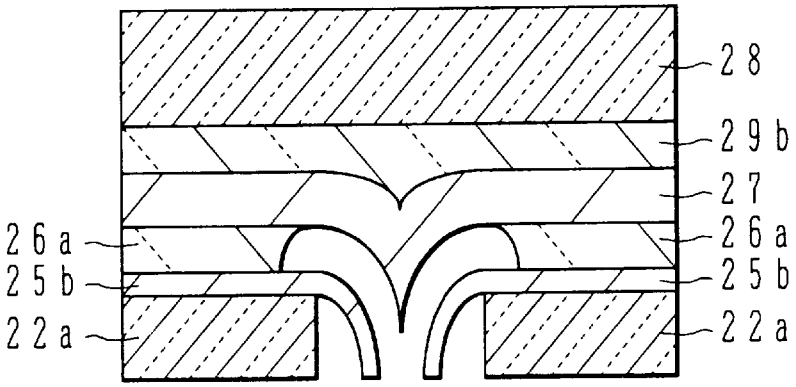

FIGS. 2A and 2B illustrate two methods for reinforcing the emitter electrode 27 with a supporting substrate 28. It is preferred that the emitter electrode 27 be reinforced with the supporting substrate 28, since the emitter electrode 27 is as thin as approximately 0.2 $\mu$m.

FIG. 2A illustrates the first reinforcing method. In the field emission device manufactured to the extent shown in FIG. 1H, a recess in the emitter electrode 27 is filled with a planarizing film 29*a* consisting of an SOG film, for example, after which the planarizing film 29*a* is etched back by anisotropic dry etching or chemical mechanical polishing (CMP) in order to planarize the surfaces of the emitter electrode 27 and planarizing film 29*a*. The planarizing film 29*a* may not consist of the SOG film, and may be formed by having phospho-silicate glass (PSG) or boron-doped phospho-silicate glass (BPSG) reflow.

Following the above, a supporting substrate 28 is bonded onto the emitter electrode 27 via electrostatic bonding or using an adhesive. The supporting substrate 28 is formed of glass, quartz or $Al_2O_3$, for example. Thereafter, the entire substrate 20, the entire side spacers 24*b* and a part of the third sacrificial film 26 are removed by the same step as that shown in FIG. 1I.

FIG. 2B illustrates the second reinforcing method. In the state illustrated in FIG. 1H, an adhesive 29*b* which is formed of glass having a low melting point or epoxy resin, for example, is poured onto the emitter electrode 27 so that the emitter electrode 27 and the supporting substrate 28 are bonded together. The adhesive 29*b* functions also to planarize the surface of the emitter electrode 27. Then, the entire substrate 20, the entire side spacers 24*b* and a part of the third sacrificial film 26 are removed by the same method as that illustrated in FIG. 1I.

Al may be employed as the adhesive 29*b*. Al can reflow at a relatively low temperature. The emitter electrode 27 and the supporting substrate 28 may be anodically bonded together via electrostatic forces which are generated by applying a high voltage of 1 kV between the supporting substrate 28 and the adhesive 29*b* (or the emitter electrode 27) while the temperature of the substrate is being maintained at 400 to 500° C. Adopting Al as the adhesive 29*b* permits the adhesive 29*b* to be utilized as an emitter wiring line.

The method for manufacturing the two-electrode field emission device having the emitter electrode and the gate electrode has been described above. Next, a method for manufacturing a three-electrode device as another example of the field emission device, will be described. The three-electrode field emission device has three electrodes, i.e., an emitter electrode, a gate electrode and an anode electrode.

FIGS. 3A to 3H illustrate the steps of manufacturing the field emission device (three-electrode device) according to the second embodiment of the present invention.

Figure 3A:
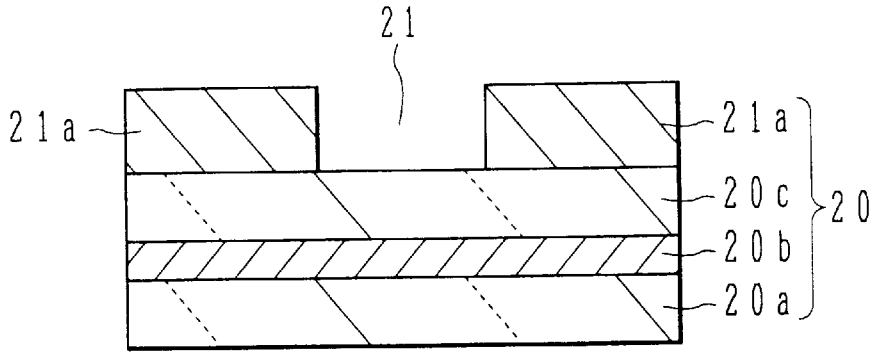
FIGS. 3A to 3H are cross sections showing the steps of manufacturing a field emission device (three-electrode device) according to the second embodiment of the present invention.

In FIG. 3A, a starting substrate 20 includes an insulation film 20*a* which is made of $SiO_2$, for example, an anode electrode 20*b*, a first sacrificial film 20*c* and a second sacrificial film 21*a* having a recess 21. Those films and electrode are laminated one on another in the order described. The film 21*a* is referred to as the "sacrificial film"

for the reason that it is used to control the shape of the gate electrode. In fact, however, the film 21*a* is utilized as a part of the gate electrode.

The anode electrode 20*b* is formed of P- or B-doped polycrystalline silicon, for example, and has a thickness of approximately 0.15 μm. The first sacrificial film 20*c* is formed of $SiO_2$, for example, and has a thickness of approximately 0.3 μm. The second sacrificial film 21*a* is made of P- or B-doped polycrystalline silicon, and has a thickness of approximately 0.3 μm.

Using photolithography and an etching technique, the second sacrificial film 21*a* with the recess 21 can be formed out of the second sacrificial film formed having a uniform thickness. The recess 21 is circular when seen in plan view, and has a diameter of approximately 0.5 μm and a depth of approximately 0.3 μm. The above-mentioned etching is achieved by anisotropic dry etching. For example, using HBr as an etching gas and setting the internal pressure of the reaction chamber at 100 mTorr, the etching is conducted through utilization of the magnetron RIE apparatus.

Figure 3B:
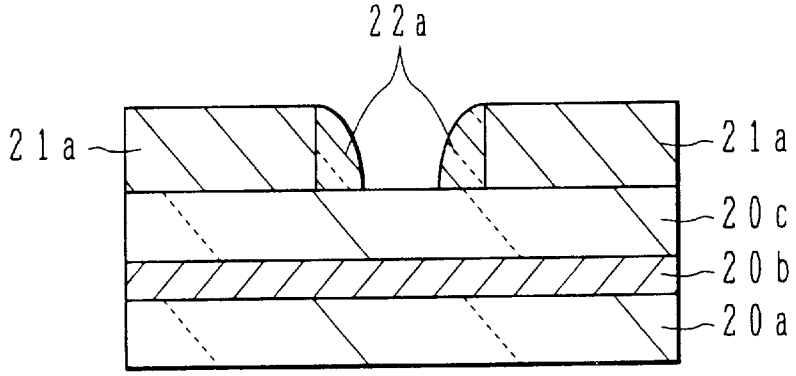

Next, as illustrated in FIG. 3B, side spacers 22*a* which are made of $SiO_2$, for example, are formed on the side walls of the second sacrificial film 21*a* by the same step as that shown in FIG. 1D.

Figure 3C:
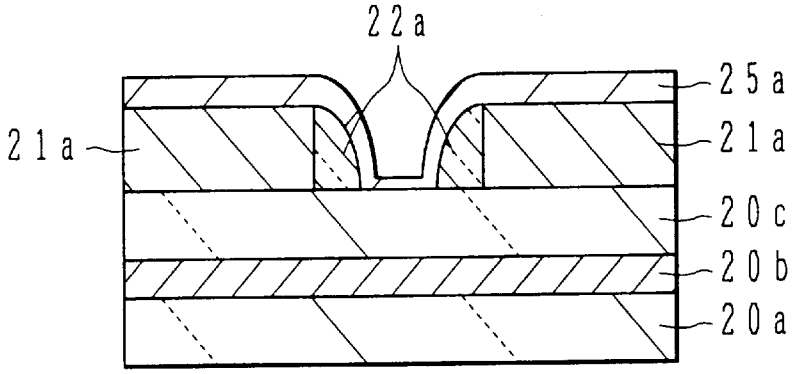

Then, as illustrated in FIG. 3C, a gate electrode 25*a* which is made of TiN, for example, is deposited over the entire substrate surface so as to have a thickness of 0.1 μm (on a large flat surface area). Using a Ti target and introducing an $N_2$+Ar gas as a work gas, the sputtering is conducted with the DC sputtering apparatus, for example. The gate electrode 25*a* is deposited thick over the upper flat surface area, and is deposited thin over the lower flat surface area. The thickness of those parts of the gate electrode 25*a* which are located on the side walls of the recess varies gradually. An ordinary sputtering method and/or vapor deposition method, conducted employing a TiN target and introducing Ar as a work gas, can also be adopted to deposit the gate electrode 25*a* which is made of TiN.

Figure 3D:
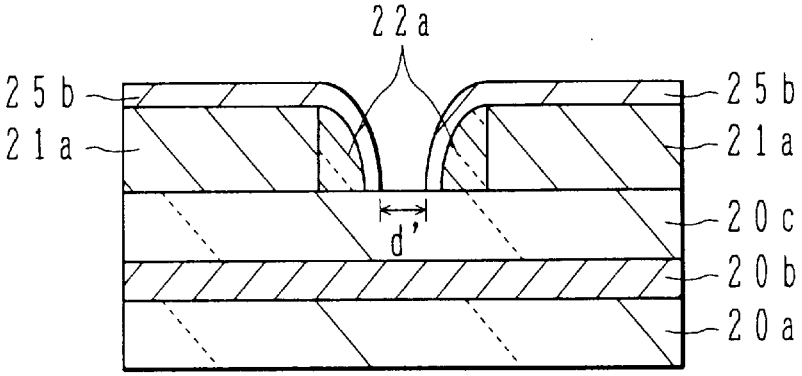

Subsequently to the above, the entire surface of the gate electrode 25*a* is anisotropically etched back by a thickness of approximately 0.05 μm so that the substrate 20*c* is exposed at the bottom of the recess (gate hole), as illustrated in FIG. 3D. A gate electrode 25*b* is left on the side surfaces of the side spacers 22*a* and the upper surface of the second sacrificial film 21*a*. The diameter d' of the bottom of the recess (gate hole) can be reduced considerably. The above-mentioned etching back is achieved by anisotropic dry etching. For example, using $Cl_2$ as an etching gas and setting the internal pressure of the reaction chamber at 125 mTorr, the etching is performed through utilization of the magnetron RIE apparatus.

Figure 3E:
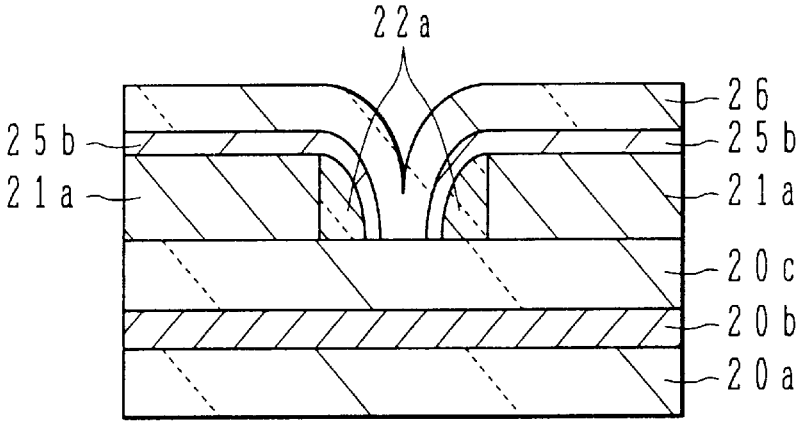

Next, as illustrated in FIG. 3E, a fourth sacrificial film 26, which is made of $SiO_2$, for example, is formed over the entire substrate surface by the atmospheric pressure CVD so that the fourth sacrificial film 26 has a thickness of 0.15 μm. The fourth sacrificial film 26 is formed under the conditions wherein $O_3$ and TEOS are used as material gasses and wherein the temperature of the substrate is set at 400° C.

Figure 3F:
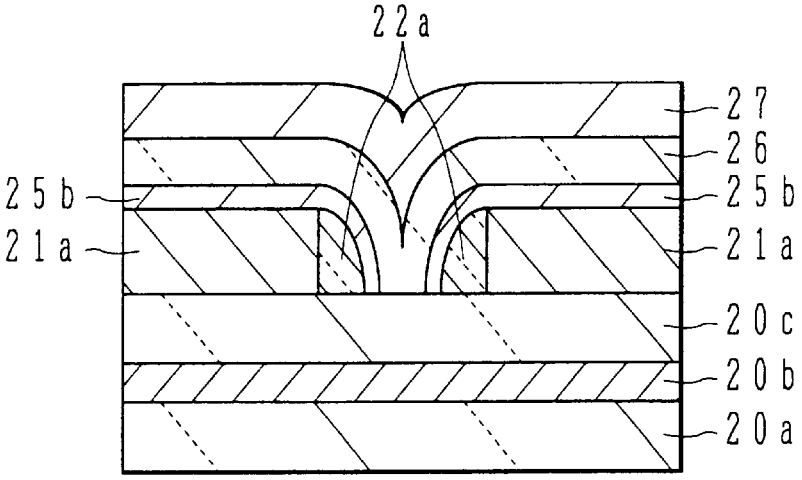

Thereafter, as illustrated in FIG. 3F, an emitter electrode 27, which is made of TiN, for example, is deposited over the entire substrate surface by the reactive sputtering method so that the emitter electrode 27 has a thickness of 0.2 μm. Using a Ti target and introducing an $N_2$+Ar gas as a work gas, the sputtering is conducted with the DC sputtering apparatus.

Figure 3G:
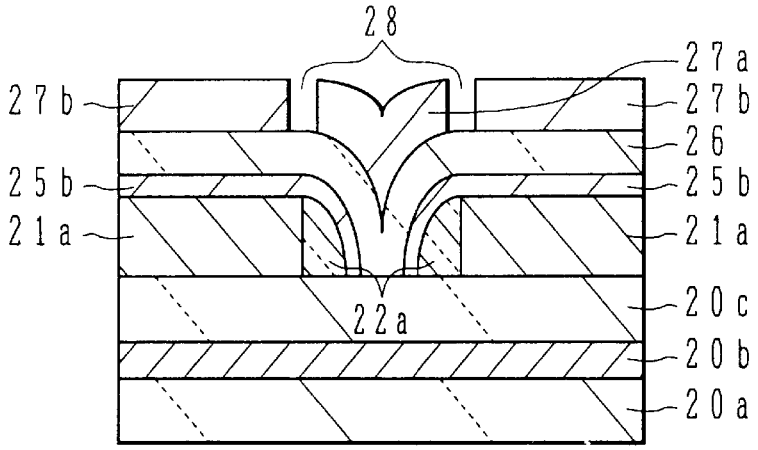

Then, a resist film (not shown) is formed by a predetermined pattern on the emitter electrode 27. Reactive ion etching (RIE) is effected using the resist film as a mask, thereby forming slit apertures 28 on both sides of an emitter electrode 27*a*, as illustrated in FIG. 3G. An emitter electrode 27*b* is one formed on the outer sides of the slit apertures 28. The RIE is performed using the magnetron RIE apparatus, employing $Cl_2$ as an etching gas and setting the internal pressure of the reaction chamber at 125 mTorr.

Figure 3H:
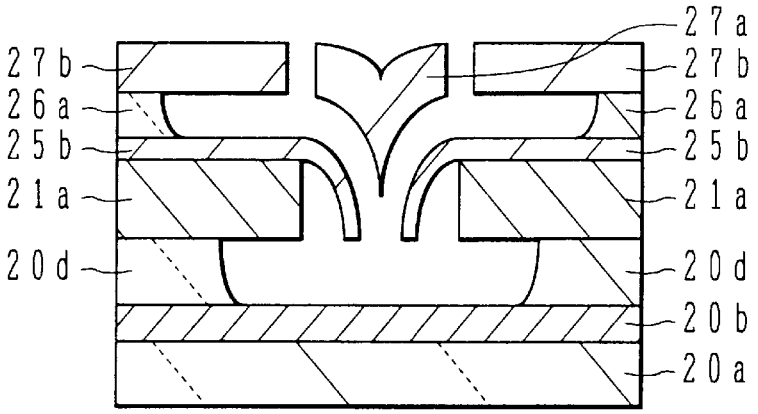

Then, an etchant is supplied from above into the slit apertures 28 so that parts of the fourth sacrificial film 26 and first sacrificial film 20*c* and the entire side spacers 22*a* are removed by isotropic wet etching. A peripheral fourth sacrificial film 26*a* and a peripheral first sacrificial film 20*d* remain unetched, as illustrated in FIG. 3H. In order to conduct the wet etching of the fourth insulation film 26 made of e.g. $SiO_2$, the first sacrificial film 20*c* and the side spacers 22*a*, HF+$NH_4F$ can be employed.

The emitter electrode 27*a*, the gate electrode 25*b* and the anode electrode 20*b* can be exposed by the above-described etching. Since the conductive second sacrificial film 21*a* has been electrically connected to the gate electrode 25*b*, the resistance of a gate wiring line can be lowered.

Figure 4:
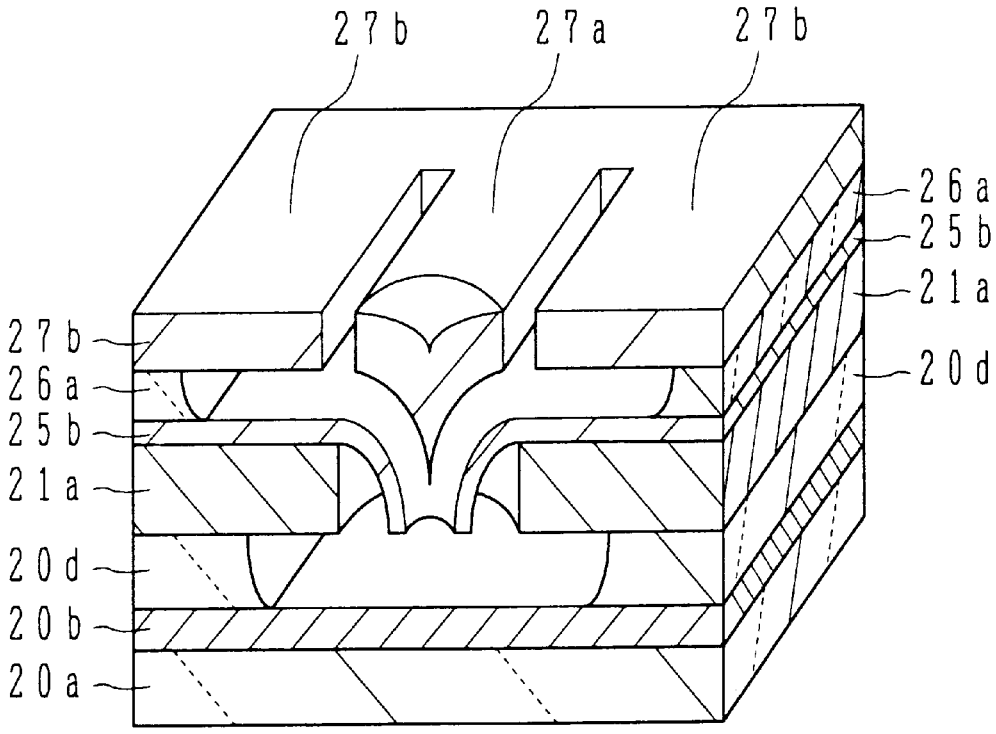
FIG. 4 is a perspective view of the field emission device illustrated in FIG. 3H.

FIG. 4 is a perspective view of the three-electrode device illustrated in FIG. 3H. The emitter electrode 27*a* is coupled to and held by the emitter electrode 27*b*. The gate electrode 25*b* has a circular hole (gate hole) near the tip of the emitter electrode 27*a*. The tip of the emitter electrode 27*a* is pointed like a needle in the vicinity of the hole in the gate electrode 25*b*.

The three-electrode device includes the emitter electrode 27*a* serving as a cathode and the anode electrode 20*b* serving as an anode. When a positive potential is applied to the gate electrode 25*b*, the emitter electrode 27*a* emits electrons toward the anode electrode 20*b*.

The diameter (gate diameter) of the gate hole can be considerably reduced also in the case of the three-electrode device.

The second sacrificial film 21*a*, located under the gate electrode 25*b* and the emitter electrode 27, can be formed using a semiconductor like polycrystalline silicon, amorphous silicon, etc., a silicide compound like WSi, TiSi, MoSi, etc., and a metal like Al Cu, W, Mo, Ni, TiN, etc. The side spacers 22*a* may be formed using a semiconductor or a conductor (metal), in place of $SiO_2$.

Figure 5A:
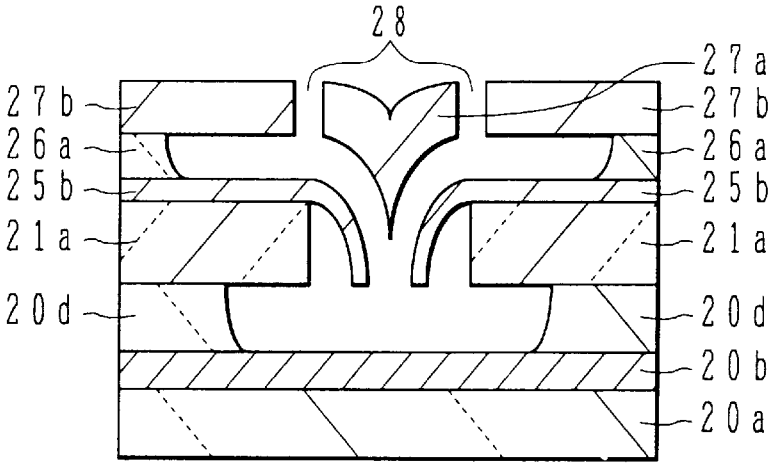
FIGS. 5A and 5B are cross sections of field emission devices according other embodiments of the present invention.

FIG. 5A illustrates another example of the three-electrode device. In the three-electrode device (FIG. 3H) described previously, the second sacrificial film 21*a* consists of a conductive film which is made of SiN, for example. In the three-electrode device illustrated in FIG. 5A, however, the second sacrificial film 21*a* consists of an insulation film which is made of SiN, for example. In the other respects, both devices are the same as each other. In the case of the second sacrificial film 21*a*, there is the need to select a material which can be etched at high speed by the etching step (FIG. 3H) to expose the electrodes. The second sacrificial film 21*a* is left even after the etching step. Forming the second sacrificial film 21*a* by using an insulation film ensures an improvement in the strength of the insulation between the gate electrode 25*b* and the anode electrode 20*b*.

Figure 5B:
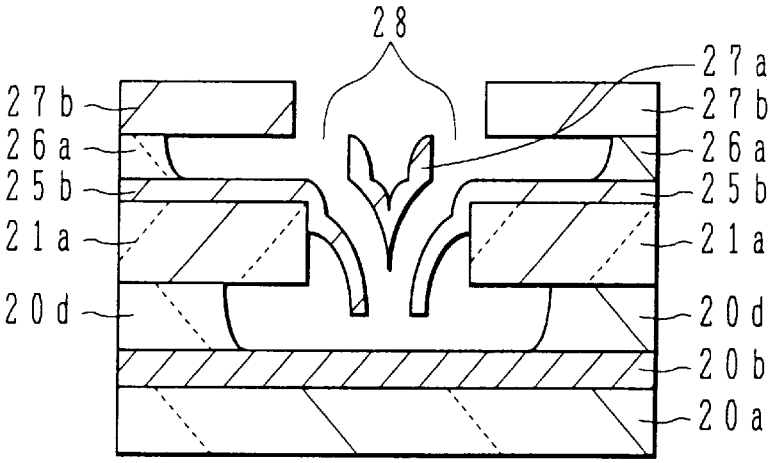

FIG. 5B illustrates another example of the three-electrode device. In FIG. 3B, the side spacers 22*a* are formed by conducting etching. If the etching is further continued (over-etching is conducted), the surfaces of the side spacers 22*a* are etched, and smaller side spacers are formed as a result. Those side spacers cover the middle and lower parts of the side walls of the second sacrificial film 21*a*. The upper parts of the side walls of the second sacrificial film 21*a* are exposed. Moreover, a recess is formed in the first sacrificial film 20*c* included in the substrate 20 as a result of the aforementioned etching.

By thereafter carrying out the same steps as those shown in FIGS. 3C to 3H, the three-electrode device illustrated in FIG. 5B can be formed. The emitter electrode 27*a* and the gate electrode 25*b* are located in lower positions than in the case of the other devices described previously, and are closer to the anode electrode 20*b* accordingly. The apex angle of the tip of the emitter electrode 27*a* and the radius of curvature of the emitter electrode 27*a* can also be reduced.

Figure 6:
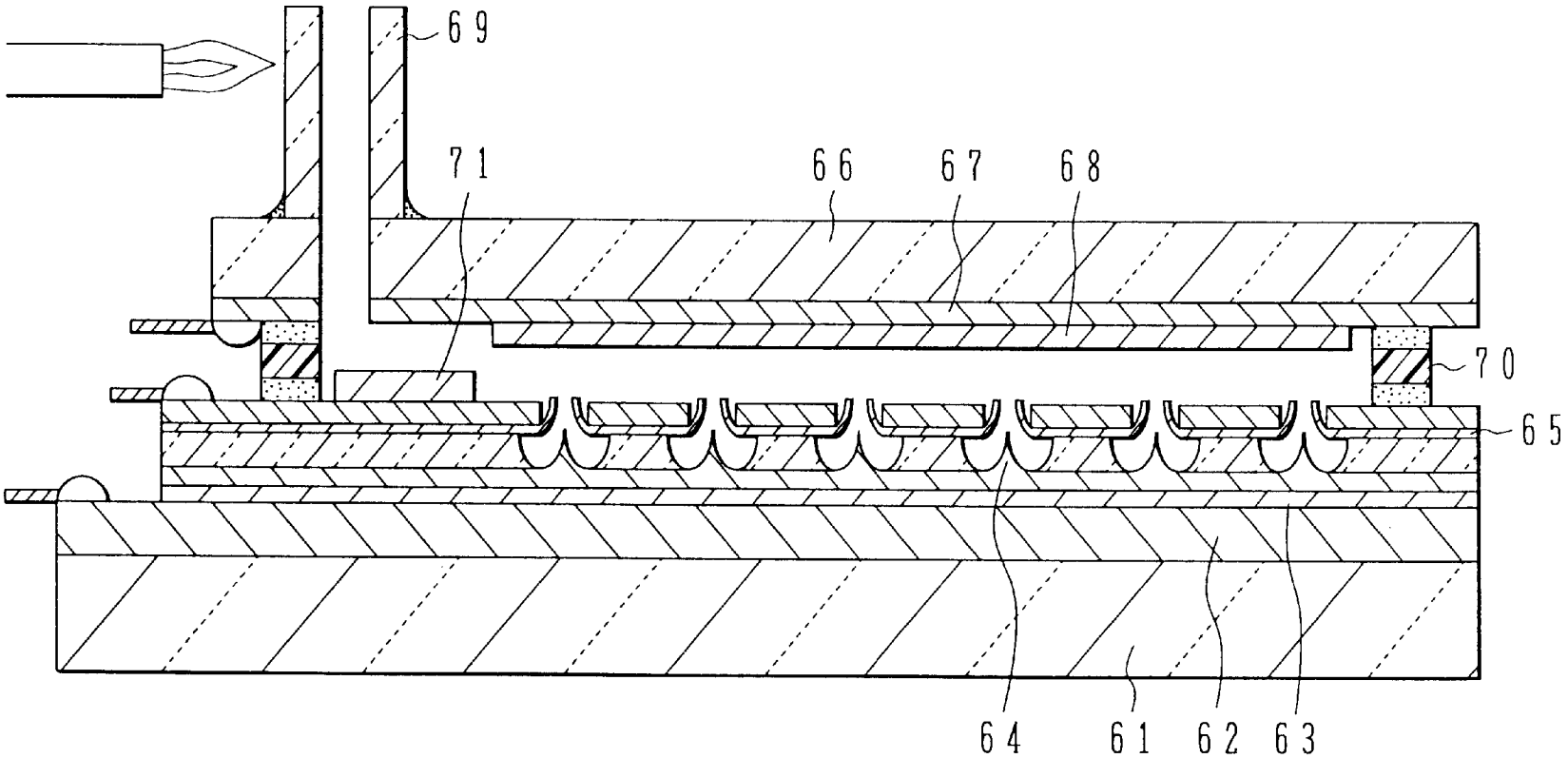
FIG. 6 is a cross section of a flat panel display employing a field emission device.
Figure 7A:
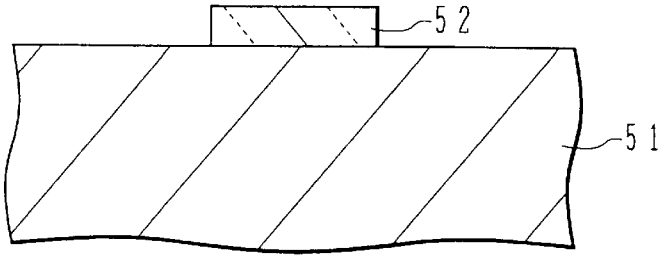
FIG.7A PRIOR ART
FIGS. 7A to 7E are cross sections showing a method for manufacturing a conventional field emission device.
Figure 7B:
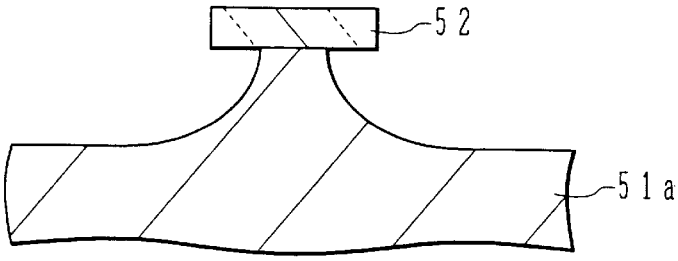
FIG.7B PRIOR ART
Figure 7C:
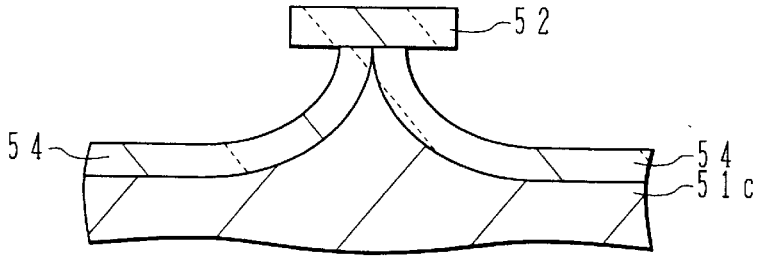
FIG.7C PRIOR ART
Figure 7D:
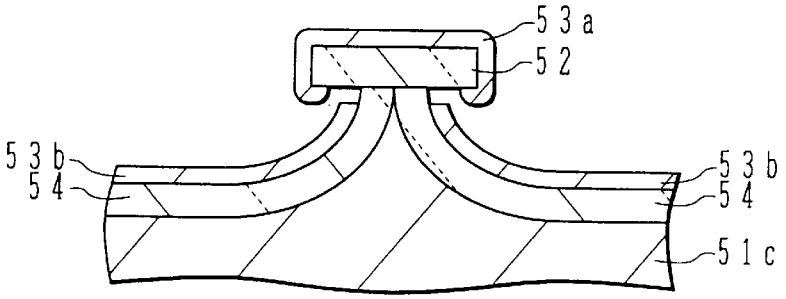
FIG.7D PRIOR ART
Figure 7E:
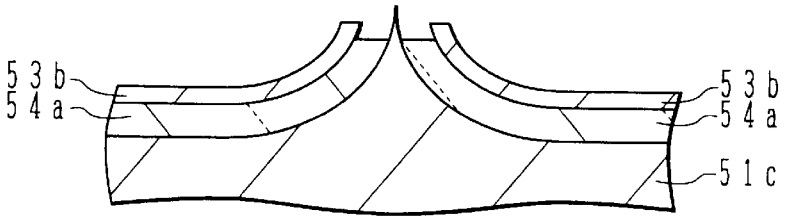
FIG.7E PRIOR ART
Figure 8A:
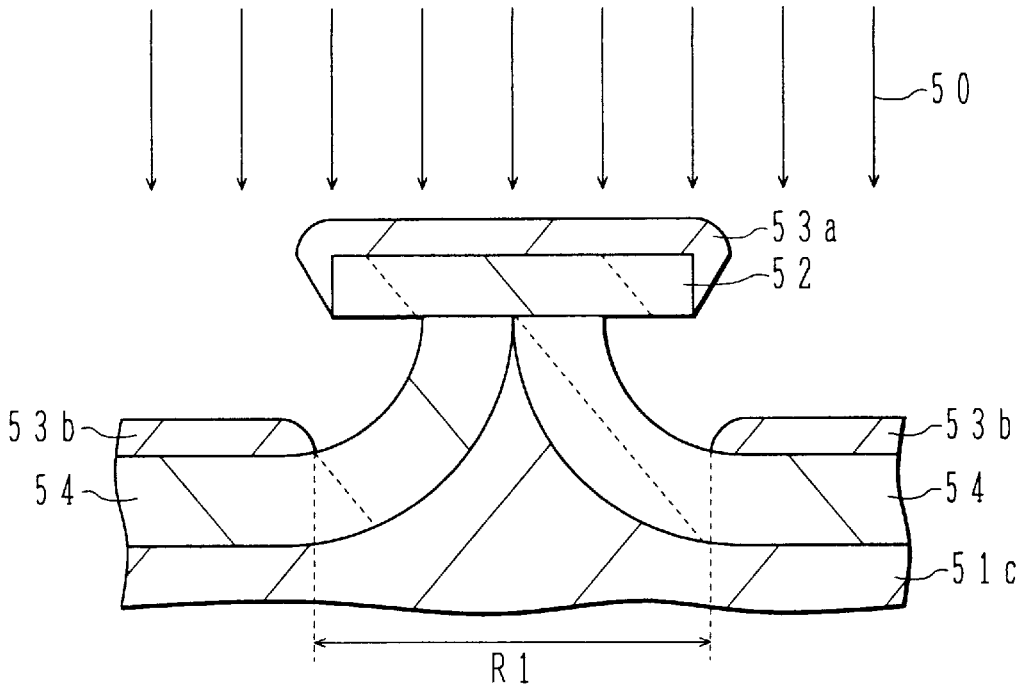
Figure 8B:
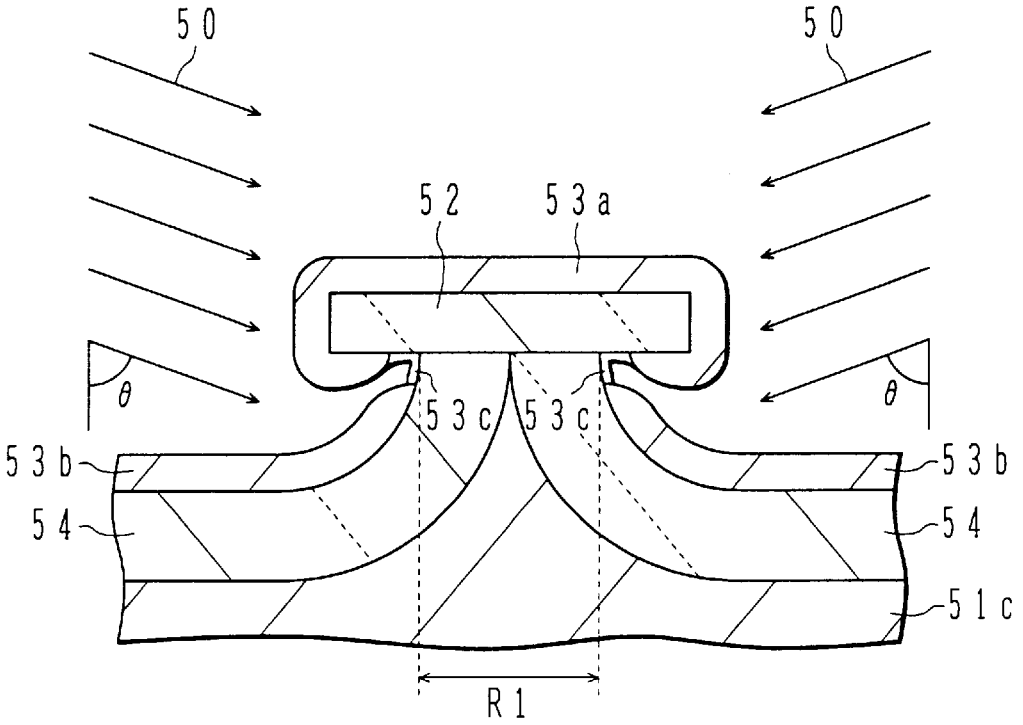
FIG. 8B is a cross section showing the step of forming a gate electrode layer by obliquely impinging Nb.
Figure 9A:
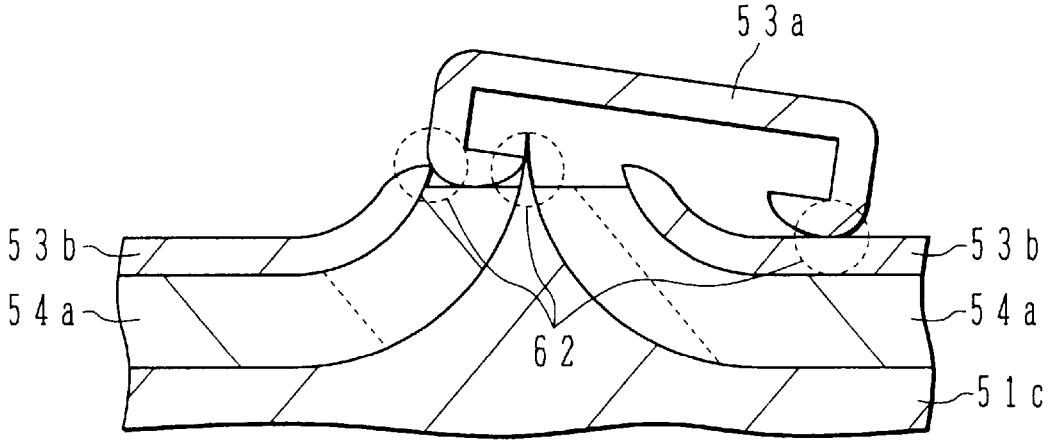
Figure 9B:
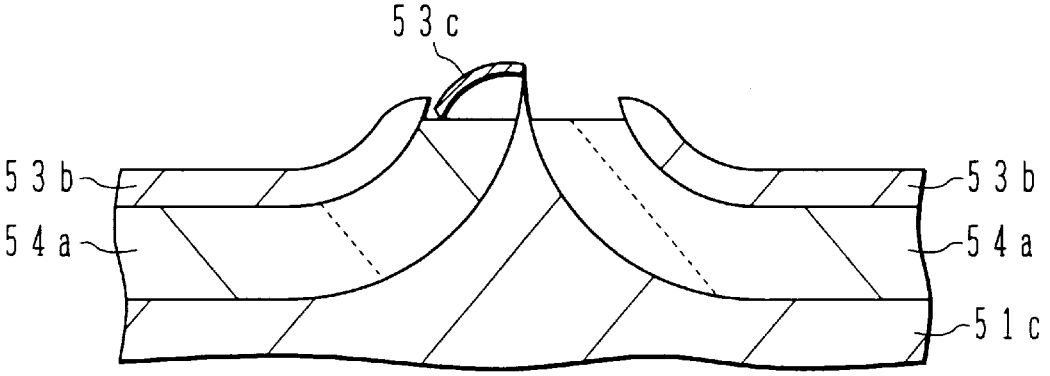
FIG. 9B is a cross section of a field emission device in which a leak current flows.

FIG. 6 is a cross section of a flat panel display employing one of the field emission devices explained previously.

The field emission device as illustrated is the two-electrode device manufactured according to one of the above-described embodiments. A wiring layer 62, which is made of Al, Cu or the like, and a resistive layer 63 which is made of polycrystalline silicon or the like, are formed on a supporting substrate 61 consisting of an insulator. A large number of emitter electrodes 64, each having a tip whose apex angle is small and having a small radius of curvature, are arranged on the resistive layer 63 so as to form a field emitter array (FEA). Each of gate electrodes 65 has a small aperture in the vicinity of a corresponding one of the emitter electrodes 64, and the gate electrodes 65 are capable of applying a voltage independently from each other through their respective apertures, although this situation is not illustrated. The emitter electrodes 64 are also capable of applying a voltage independently from each other.

An opposite substrate including a transparent substrate 66, which is made of glass or quartz, is arranged facing an electron source which includes the emitter electrodes 64 and the gate electrodes 65. The opposite substrate further includes a transparent electrode (anode electrode) 67 made of ITO or the like and provided under the transparent substrate 66, and a phosphor member 68 provided under the transparent electrode 67.

The electron source and the opposite substrate are joined together with a spacer 70 sandwiched therebetween so that a gap between the electron source and the opposite substrate is maintained at approximately 0.1 to 5 mm. The spacer 70 is formed of a glass substrate to which an adhesive has been applied. Glass having a low melting point, for example, can be used as the adhesive.

The spacer 70 may be formed of not the glass substrate, but an adhesive such as epoxy resin and in which glass beads or the like have been scattered.

A getter 71 is made of, for example, Ti, Al, Mg or the like, and prevents a degas or outgas from adhering again to the surfaces of the emitter electrodes 64.

An evacuation pipe 69 is provided in advance on the opposite substrate. Evacuation from the interior of the flat panel display is conducted to the extent of approximately $10^{-5}$ to $10^{-9}$ Torr via the evacuation pipe 60, after which the evacuation pipe 69 is sealed utilizing a burner or the like. Thereafter, a wiring for the anode electrode (transparent electrode) 67, the emitter electrodes 64 and the gate electrodes 65 is arranged, thus finishing the flat panel display.

The anode electrode 67 is constantly kept at a positive potential. A display pixel is two-dimensionally selected by an emitter wiring line and a gate wiring line; in other words, a field emission device located at the intersection of the emitter wiring line and the gate wiring line to which voltages have been applied, is selected.

A negative potential is applied to the emitter electrodes, and a positive potential is applied to the gate electrodes, as a result of which the emitter electrodes emit electrons toward the gate electrodes. Those parts (pixels) of the phosphor member 68 which the electrons have struck emit light.

According to the above-described embodiments, the diameter d of the recess 21 is reduced to a resolution limit (FIG. 1B), the side spacers 24*b* are formed (FIG. 1D), and thereafter the gate electrode 25*b* is formed. By so doing, the diameter (gate diameter) d' of the gate hole can be reduced considerably. In particular, a field emission device whose gate diameter d' is 0.3 $\mu$m or less can be manufactured with ease. Indeed, a field emission device having a gate diameter of 0.06 $\mu$m (smallest in the world) could be manufactured.

Furthermore, the accuracy with which the emitter electrode and the gate electrode are positioned can be improved by controlling them to predetermined shapes. The range of choice of materials for the emitter electrode and the gate electrode in manufacturing a field emission device is wide. During the manufacturing, a crack hardly occurs in a sacrificial film.

The present invention has been explained referring to the embodiments. However, the present invention is not limited to the embodiments, and various modifications, improvements, combinations, etc. are possible, as should be apparent to those skilled in the art.

What is claimed is:

1. A method for manufacturing a field emission device, comprising the steps of:

(a) forming a first sacrificial film on an upper surface of a substrate;

(b) forming a recess in said first sacrificial film;

(c) forming a second sacrificial film on said first sacrificial film and in said recess;

(d) anisotropically etching back said second sacrificial film, thereby to leave, as side spacers, parts of said second sacrificial film which are located on side walls of said recess and to expose said first sacrificial film and a part of said substrate;

(e) forming a first conductive film as a gate electrode on said first sacrificial film, said side spacers and the exposed part of said substrate, said first conductive film having a thick part located on said first sacrificial film and a thin part located on said substrate;

(f) etching back said first conductive. film, thereby to expose said substrate at a bottom of said recess and to leave said first conductive film on said first sacrificial film;

(g) forming a first insulation film with a cusp on said first conductive film;

(h) forming a second conductive film as an emitter electrode on said first insulation film; and (i) exposing an end portion of said first conductive film and an end portion of said second conductive film.

2. The method according to claim 1, further comprising the step of:

(j) fixing said second conductive film to a supporting substrate after said step (h).

3. The method according to claim 1, wherein said substrate includes a conductive layer serving as an anode electrode, and said step (i) is the step of exposing said end portion of said first conductive film, said end portion of said second conductive film and a surface of said conductive layer.

4. The method according to claim 1, wherein said first and second sacrificial films are made of insulators.

5. The method according to claim 1, wherein at least one of said first and second sacrificial films is made of a conductor or a semiconductor.

6. The method according to claim 5, wherein said first sacrificial film, said first conductive film and said second conductive film are made of materials selected from a group consisting of polycrystalline silicon, amorphous silicon, WSi, TiSi, MoSi, Al, Cu, W, Mo, Ni and TiN.

7. The method according to claim 1, wherein said first insulation film is anisotropically deposited by said step (g).

8. The method according to claim 1, wherein a recess is formed in said substrate by the etching back conducted by said step (f).

9. The method according to claim 1, wherein the recess formed in said first sacrificial film by said step (b) extends up to said substrate.

10. The method according to claim 1, wherein said step (b) is the step of forming said recess by photolithography and etching.

11. The method according to claim 1, wherein an aperture having a diameter of 0.3 $\mu$m or less is formed in said first conductive film by the etching conducted by said step (f).

* * * * *